US005697418A

United States Patent [19]

Bardot et al.

[11] Patent Number: 5,697,418

[45] Date of Patent: Dec. 16, 1997

[54] METHOD OF MAKING CERAMIC CORES FOR USE IN CASTING

[75] Inventors: Thierry Alain Bardot, Enghien Les Bains; Nadine Burkarth, Fonsorbes; Chantal Sylvette Marie Noëlle Langlois, Franconville; Nicolas Lequeux, Massy, all of France

[73] Assignee: Societe Nationale d'Etude et de Construction de Moteurs d'Aviation "Snecma", Paris, France

[21] Appl. No.: 672,297

[22] Filed: Jun. 28, 1996

Related U.S. Application Data

[63] Continuation of Ser. No. 322,342, Oct. 13, 1994, abandoned.

[30] Foreign Application Priority Data

Oct. 13, 1993 [FR] France ..... 93 12163

[51] Int. Cl.[6] ..... B22C 9/10

[52] U.S. Cl. ..... 164/28; 164/520; 164/529

[58] Field of Search ..... 164/529, 369, 164/520, 14, 15, 28

[56] References Cited

U.S. PATENT DOCUMENTS

| | | | |
|---|---|---|---|
| 3,686,006 | 8/1972 | Horton | 164/369 |
| 3,688,832 | 9/1972 | Horton | 164/369 |
| 4,685,503 | 8/1987 | Miyata . | |
| 5,067,548 | 11/1991 | Uram . | |

FOREIGN PATENT DOCUMENTS

| | | | |
|---|---|---|---|
| 0 328 452 | 8/1989 | European Pat. Off. . | |
| 2 371 257 | 6/1978 | France . | |
| 1 187 768 | 4/1959 | Germany . | |
| 50-1031 | 1/1975 | Japan | 164/15 |

OTHER PUBLICATIONS

Patent Abstracts Of Japan, vol. 4, No. 92 (M-018)3 Juillet 1980 of JP-A-55 050 947 (Hitachi Meta Precision;KK) Apr. 14, 1980.

Database WPI, Week 7751, Derwent Publications Ltd., London GB; AN 77-90192 51! & DD-A-127 213 (Akad Wissenschaft Ddr) Sep. 14, 1977.

Database WPI, Week 7631, Derwent Publications Ltd., London GB; AN 76-58291X 31! & JP-A-50 029 241 (Janome Sewing Mach Ltd) Mar. 25, 1975.

Database WPI, Week 7807, Derwent Publications Ltd., London GB; AN 78-13185A 07! & JP-A-53 000 212 (Toyota Motor Corp) Jan. 5, 1978.

Database WPI, Week 7830, Derwent Publications Ltd., London, GB; AN 78-54451A 30! & JP-A-53 070 030 (Taiyo Bussan KK) Jun. 22, 1978.

*Primary Examiner*—Kuang Y. Lin

*Attorney, Agent, or Firm*—Oblon, Spivak, McClelland, Maier & Neustadt, P.C.

[57] ABSTRACT

A method of making a ceramic core for use in a casting process comprises the steps of forming a core in a mould by hot injection of a thermoplastic paste consisting of a refractory ceramic composition and an organic fraction, eliminating the organic fraction from the core by heat treatment, heat treating the core to achieve the minimum consolidation necessary to enable the core to be handled, impregnating the porous structure of the core with a solution comprising a silica or alumina based elementary oxide colloid, and eliminating the liquid from the impregnated product.

11 Claims, 2 Drawing Sheets

METHOD OF MAKING CERAMIC CORES FOR USE IN CASTING

This application is a continuation of application Ser. No. 08/322,342, filed on Oct. 13, 1994, now abandoned.

BACKGROUND OF THE INVENTION

1. Field of the invention

The present invention relates to a method of making, using a thermoplastic paste, ceramic cores for use in a casting process.

The use of casting cores of a type termed "ceramic" is known in particular in certain applications which require the cores to satisfy a number of characteristics and strict quality criteria such as resistance to high temperatures, the absence of reactivity, dimensional stability and good mechanical characteristics. Among the applications which impose such demands are aeronautical applications such as, for example, the casting of turbine blades for turbojet engines. The improvement of casting processes, having evolved from equi-axis casting to casting with directional or monocrystalline solidification, has increased still further the demands made on cores, the use and the complexity of which are dictated by the desire for high performance for the parts to be obtained, as is the case for example for internally cooled hollow vanes. These fields of application are connected with precision casting processes, and in particular with the process known as "lost wax casting". In all cases, the use of a core is involved in the manufacture of hollow parts.

In the so-called lost wax casting method, use is made of a core of ceramic material which is held in the mould while the metal is cast, the outer surface of the core forming the inner surface of an internal cavity of the finished product obtained in this way. The accuracy and the dimensional stability of the core are therefore essential for complying with the intended thicknesses for the cast metal parts.

2. Summary of the Prior Art

Examples of compositions intended for the preparation of such cores are given in FR-A-2 371 257 and include fused silica, powdered zircon and cristobalite, which is a form of crystallized silica. A silicone resin is used as a binder, and additional elements such as a lubricant and a catalyst may be added in small amounts. The preparation process is also described.

Generally, the cores used for casting the parts and blades are composed of ceramic having a generally porous structure: these cores being produced from a mixture composed of a refractory fraction (in the form of particles) and a more or less complex organic fraction. Another example is described in EP-A-0 328 452. In a manner known per se, the forming of casting cores, particularly from thermoplastic pastes, may be made by moulding using, for example, an injection moulding machine. This forming process is followed by a binder removal operation whereby the organic fraction of the core is eliminated by various known means such as sublimation or thermal degradation, depending on the materials used. A porous structure thus results, and a firing heat treatment is then applied to the remaining refractory fraction to consolidate the porous core structure. This treatment introduces a dimensional change, in the form of a shrinkage which is often non-isotropic in the volume of the core, relative to the initial shape.

At this stage, it may be necessary to reinforce the core so that it does not suffer damage during the following use cycle. In this case it is known, in particular, to carry out an impregnation with an organic resin.

The core is then ready for use, that is to say it is ready for use in the following so-called lost wax manufacture cycle comprising:

injection of the wax pattern around the core making the shell mould elimination of the wax pattern various heat treatments: namely burning the wax residues, sintering the shell mould, preheating, casting the alloy, and cooling the alloy elimination of the core.

Difficulties remain with these known processes, and the results obtained are not fully satisfactory. Distortions in the geometry of the core have repercussions on the finished part, when a dimensional tolerance of the order of ±0.1 mm may be required. An improvement of the results requires a dimensional stability of the cores to be achieved, which is difficult to master as the structure of the material changes during the successive heat treatments mentioned hereinabove: namely firing the core, and heat exchanges within the casting shell mould.

In addition, the cores must have good mechanical stability and sufficient strength to withstand mechanical and thermomechanical stresses during the stages of the lost wax process: namely injection of the wax pattern around the core, formation of the shell mould, removal of the wax, burning, sintering, and the casting of the alloy around the core.

The properties of the core result from the firing thereof, but in the known processes the consolidation of the structure of the refractory fraction of the core by the firing is accompanied by a shrinkage. This phenomenon brings about difficulties in perfecting the products and equipment for forming the core, such as the injection mould, and it has repercussions on the quality of the cores, the amplitude of the shrinkage anisotropies adding themselves to the dimensional distortions. It is the aim of the invention to improve the method of making ceramic cores by reducing these dimensional changes while restraining the dimensional distortions and retaining an adequate mechanical behaviour.

SUMMARY OF THE INVENTION

To this end, according to the invention there is provided a method of making a ceramic core for use in a precision casting process, comprising the steps of:

forming a core in a known manner, such as by hot injection in a metal mould, from a thermoplastic paste composed of a refractory ceramic fraction and an organic fraction;

eliminating said organic fraction from said core in a known manner, such as by sublimation or thermal degradation;

heat treating the remaining refractory ceramic fraction of said core such that consolidation of the structure of said refractory ceramic fraction is limited to the minimum necessary to provide said core with sufficient mechanical strength for it to be handled and so as to restrict shrinkage of said core to a minimum;

impregnating the porous structure of said core by a solution containing at least one colloid of elementary oxide selected from the group consisting of colloidal silica and colloidal alumina and possible additions selected from mixtures of several sols and mixtures of sols and salts; and, eliminating the liquid from the impregnated core.

The elimination of the liquid from the impregnated core may be achieved by drying.

In certain cases an additional heat treatment may be necessary after the impregnation to ensure a dilatometric stability of the product.

The method in accordance with the invention results in the dry residues of the impregnation process forming particles which partly fill up the porosity of the core, the effect of which is to reinforce the mechanical strength of the core by consolidating it, and to hold shrinkage to a small extent, without appreciable change during the subsequent heat treatments.

Other features and advantages of the invention will become apparent from the following description of embodiments of the invention, given by way of example and with reference to the attached drawings.

DESCRIPTION OF THE PREFERRED EMBODIMENTS

Figure 1:
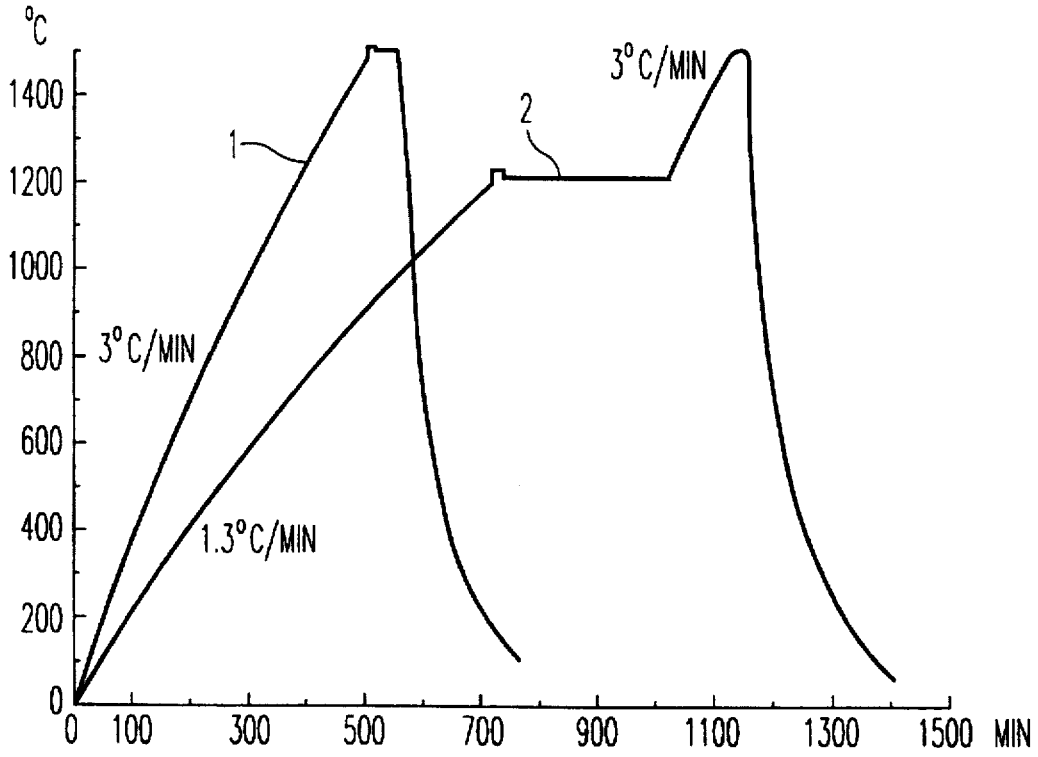
FIG. 1 shows temperature variation curves during tests of parts representative of casting cores obtained by a method in accordance with the invention.

The perfecting of the method of making ceramic cores for precision casting was carried out starting from experimental tests. Representative core parts were thus made from a thermoplastic ceramic paste using known injection techniques. A first composition I comprised a ceramic mineral charge based on fused silica mixed with powdered zircon and an organic synthetic wax based waxy binder.

A second composition II, in addition to the components of the first composition described above, further included in the mineral charge a small fraction of crystallized silica and a mineral demoulding agent.

The binding agent in the parts obtained was then removed by heating the parts to about 200° C., as is known per se. The parts were then heat treated. Satisfactory results were obtained after treatment at 1100° C. for 5 hours. A presintering was thus obtained without significant shrinkage resulting, and an acceptable mechanical stability was achieved so as to permit handling the cores without risk of damage. At least 30% open porosity was noted. Depending on applications, the heat treatment temperature may range from 1000° C. to 1150° C. and the duration may be from 1 to 5 hours.

For carrying out the impregnation of the parts several compositions were tested. A first composition A was an aqueous colloidal suspension of silica particles containing 40% silica by weight. After 24 hours impregnation, about 90% of the open porosity is impregnated. After oven drying at 70° C for 24 hours, a mass gain of the parts ranging from 8.7% to 9.5% was noted. A definite improvement of the mechanical stability was observed. Drying may be carried out in vacuo.

A second composition B was tested consisting of a colloidal suspension containing 10% of alumina, obtained by dispersing boehmite/A100H powder in a 0.7% acetic acid solution. A 90% impregnation of the open pores of the parts was also obtained at the end of 24 hours. After drying and decomposition of the boehmite into alumina at high temperature a 3% gain in the mass of the parts was obtained.

A mullite formation reaction was produced according to:

$$3\,Al_2O_3+2\,SiO_2 \rightarrow 3Al_2O_3 \cdot 2SiO_2$$

A third composition C was obtained by mixing the two preceding compositions A and B, the colloidal silica being added to the solution of boehmite in acetic acid at 0.7%. In this case impregnation achieved 80 to 90% filling of the open porosity of the parts in 24 hours, and the mass gain of the parts was 3 to 3.5% after heat treatment.

A fourth composition D used was a sol obtained by mixing colloidal silica (composition A above) and an aluminium nitrate solution.

For composition D, as for composition C, the mixtures were made so as to obtain, after drying, a mixture of alumina and silica in the stoichiometric proportion of mullite, the sol obtained being charged with 8% of $Al_2O_3$ and 3.1% $SiO_2$. The very low viscosity solution permits in this case an impregnation of the pores close to 100%, and after heat treatment of the parts, carried out at 1150° C. for one hour, a mass gain of 2.6% was noted.

Depending on the applications, before casting metal around the core it may be subjected to a preheating, preferably at a temperature between 1000° C. and 1100° C. for a period of from 1 to 4 hours.

The tests carried out corresponding to the implementation of the method of making ceramic cores in accordance with the invention made it possible to record significant and advantageous results.

Dilatometric measurements taken with an absolute dilatometer enabled the shrinkage of the parts to be determined as a function of temperature, this corresponding to the dimensional variations of the parts which constitute an important quality criterion in the utilization of precision casting cores.

The parts obtained using the second composition II described above were subjected either to a heating cycle with the temperature rising progressively to 1500° C., which corresponds to the temperature reached by the cores during the casting of superalloys, as represented by the curve 1 in FIG. 1, or to a heating cycle including an intermediate stage of 5 hours at 1200° C. as represented by curve 2 in FIG. 1, the temperature in °C. being plotted as ordinates and the time in minutes as abscissae.

Figure 2:
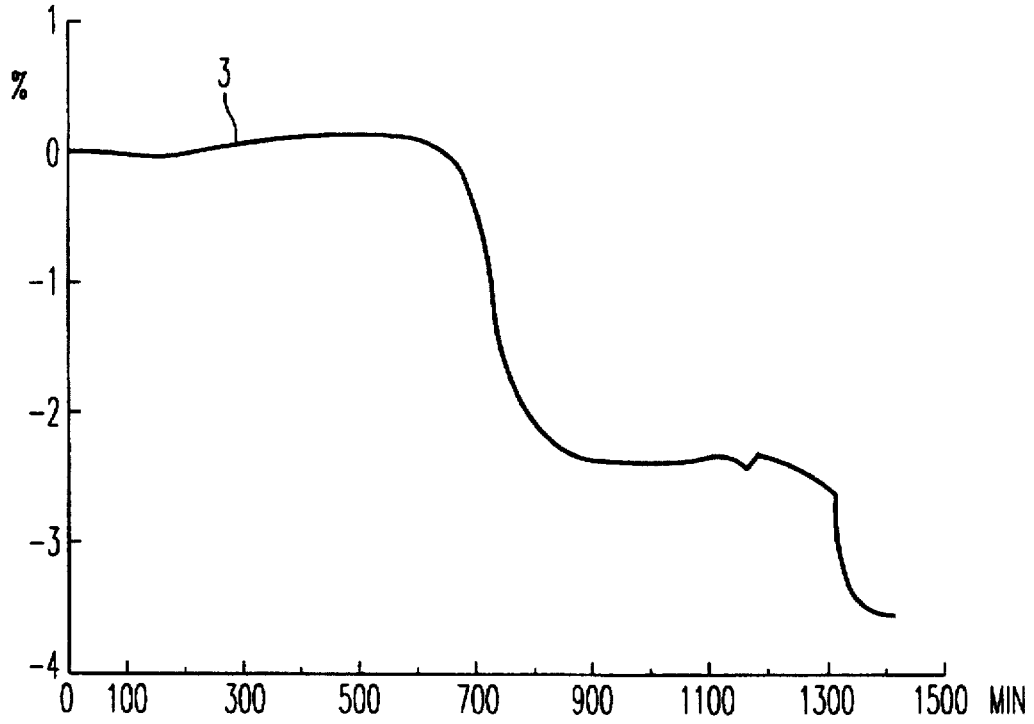
FIG. 2 represents a percentage shrinkage variation curve as a function of a temperature cycle for a part obtained by a prior art method.

The variation of the shrinkage with temperature for a part made from composition II using a prior art method and subjected to the heating cycle of curve 1 of FIG. 1 is shown by curve 3 in FIG. 2, the percentage shrinkage being plotted as the ordinate.

Figure 3:
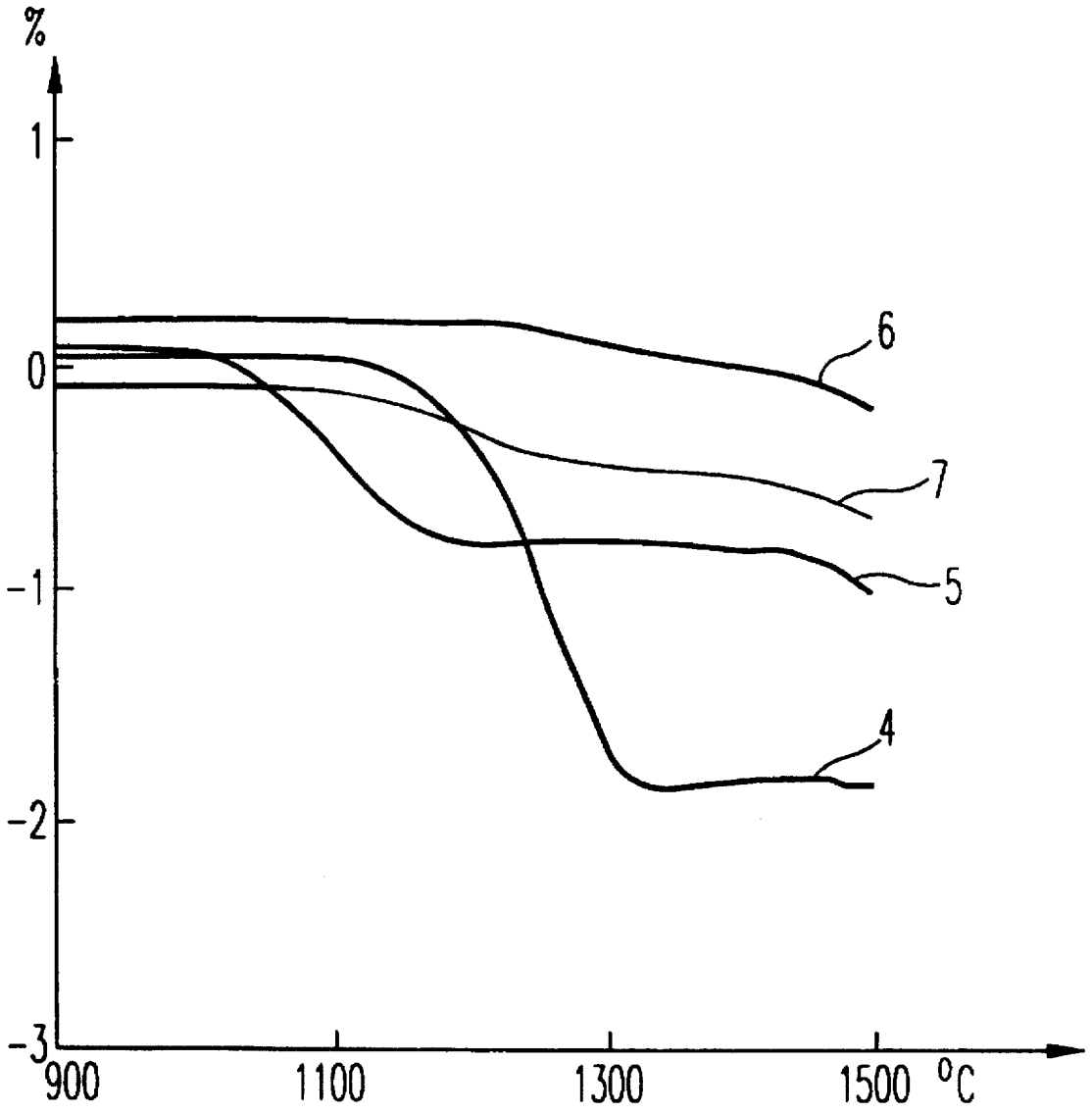
FIG. 3 shows comparative percentage shrinkage variation curves as a function of temperature for the products of various embodiments of the method in accordance with the invention.

The curves in FIG. 3 represent comparative shrinkage variations for parts made from composition II using a method in accordance with the invention:

- curve 4 representing a part without infiltration;
- curve 5 representing a part with an infiltration by composition A;
- curve 6 representing a part with an infiltration by composition B;
- curve 7 representing a part with an infiltration by composition D.

The tests carried out and the results obtained show that the operation of impregnating parts made of compositions used for making ceramic cores for precision casting with colloidal oxides of silica, alumina or mullite precursor type ensures a measured shrinkage of the parts which is from 2 to 7 times lower at the completion of heat treatment at 1500° C. than the result obtained for non-impregnated parts made using the prior art method. The impregnated support exhibits a mechanical stability on cold bending increased by 50 to 70%, depending on the impregnating agent used.

In addition, the method in accordance with the invention prevents the cores from being too brittle. Impregnation after sintering by means of an organic resin of "adhesive" type, which has been applied in the past and has the disadvantage of causing deformation of the cores during use, can thus be avoided. Satisfactory mechanical properties of core stability are achieved with the method of the invention, particularly with respect to thermal shock resistance and mechanical stability in the hot state, especially on bending, which is increased by 170% to 230% depending on the impregnating agent used.

We claim:

1. A method of making a ceramic core for use in a precision casting process, comprising the steps of:

forming a core from a thermoplastic paste comprising a refractory ceramic fraction and an organic fraction, wherein said refractory ceramic fraction comprises fused silica admixed with powered zircon and said organic fraction comprises a binder comprising an organic synthetic wax;

eliminating said organic fraction from said core;

heat treating the remaining refractory ceramic fraction of said core at a temperature of from 1000° C. for a period of from 1 to 5 hours, such that structure consolidation of said refractory ceramic fraction is limited to a minimum amount necessary to provide said core with sufficient mechanical strength for handling and so as to minimize shrinkage of said core having at least 30% open porosity;

impregnating a porous structure of said core with a solution comprising at least one colloid of elementary oxide selected from the group consisting of colloidal silica and colloidal alumina; and, eliminating any remaining liquid from the impregnated core.

2. A method according to claim 1, wherein said step of eliminating said organic fraction from said core is carried out separately from the consolidation heat treatment step.

3. A method according to claim 1, wherein said step of eliminating said organic fraction from said core is effected during said heat treatment step.

4. A method according to claim 1, wherein said step of eliminating the liquid from the impregnated core is effected by drying.

5. A method according to claim 4, wherein said drying is carried out under vacuum.

6. A method according to claim 4, wherein said drying is carried out in a drying oven at 70° C for 24 hours.

7. A method according to claim 1, wherein the impregnating solution used is colloidal boehmite and the duration of said impregnating step is 24 hours.

8. A method according to claim 1, further comprising the step of preheating said core before the metal is cast in said precision casting process, whereby the impregnation residues and the refractory ceramic part of the core react so as to reinforce the core and ensure good mechanical resistance to high casting temperatures.

9. A method according to claim 8, wherein said preheating step is carried out at a temperature between 1000° C. and 1100° C. for a period of from 1 to 4 hours.

10. The method of claim 1, wherein impregnation of a porous structure of said core is with a solution further comprising one or more additives selected from mixture of several sols and mixtures of sols and salts.

11.The method of claim 1, wherein said refractory ceramic fraction further comprises crystallized silica and a mineral demoulding agent.

* * * * *

UNITED STATES PATENT AND TRADEMARK OFFICE

CERTIFICATE OF CORRECTION

PATENT NO. : 5,697,418

DATED : DECEMBER 16, 1997

INVENTOR(S) : Thierry Alain BARDOT, et al

It is certified that error appears in the above-identified patent and that said Letters Patent is hereby corrected as shown below:

Column 5, line 28, "from 1000°C." should read --from 1000°C. to 1150°C.--.

Signed and Sealed this

Eighth Day of September, 1998

*Attest:*

Bruce Lehman

BRUCE LEHMAN

*Attesting Officer*

*Commissioner of Patents and Trademarks*